US008122658B2

(12) United States Patent
Sondermann

(10) Patent No.: US 8,122,658 B2
(45) Date of Patent: Feb. 28, 2012

(54) REVERSIBLE BASEBOARD FOR COVERING A FLOORING BORDER

(75) Inventor: Frank Sondermann, Drolshagen (DE)

(73) Assignee: Kueberit Profile Systems GmbH & Co. KG, Luedenscheid (DE)

( * ) Notice: Subject to any disclaimer, the term of this patent is extended or adjusted under 35 U.S.C. 154(b) by 44 days.

(21) Appl. No.: 12/590,302

(22) Filed: Nov. 4, 2009

(65) Prior Publication Data

US 2010/0281798 A1 Nov. 11, 2010

(30) Foreign Application Priority Data

Nov. 5, 2008 (DE) ..... 20 2008 014 702 U
Nov. 17, 2008 (DE) ..... 20 2008 015 223 U

(51) Int. Cl.
*E04B 2/00* (2006.01)

(52) U.S. Cl. ..... 52/288.1; 52/290; 52/716.1; 52/287.1

(58) Field of Classification Search ..... 52/288.1, 52/287.1, 290, 312, 716.1
See application file for complete search history.

(56) References Cited

U.S. PATENT DOCUMENTS

| | | | | | |
|---|---|---|---|---|---|
| 1,250,594 | A | * | 12/1917 | Knapp | 52/288.1 |
| 1,917,388 | A | * | 7/1933 | Nelson | 52/287.1 |
| 2,090,588 | A | * | 8/1937 | Witsell | 52/35 |
| 2,297,887 | A | * | 10/1942 | Hall et al. | 52/718.04 |
| 3,228,160 | A | * | 1/1966 | O'Brien | 52/242 |
| 3,841,022 | A | * | 10/1974 | Thodos | 47/33 |
| 4,204,376 | A | * | 5/1980 | Calvert | 52/309.1 |
| 4,569,171 | A | * | 2/1986 | Kuhr et al. | 52/242 |
| 4,589,449 | A | * | 5/1986 | Bramwell | 138/162 |
| 4,706,427 | A | * | 11/1987 | Zeilinger | 52/287.1 |
| 4,845,910 | A | * | 7/1989 | Hanson et al. | 52/287.1 |
| 5,086,598 | A | * | 2/1992 | Weldy | 52/288.1 |
| 6,122,872 | A | * | 9/2000 | Sauter | 52/288.1 |
| 6,324,799 | B1 | * | 12/2001 | Salvitti | 52/287.1 |
| 6,729,087 | B2 | * | 5/2004 | Sauter | 52/290 |
| 2004/0168384 | A1 | * | 9/2004 | Wesolowska | 52/287.1 |
| 2005/0011159 | A1 | * | 1/2005 | Standal et al. | 52/716.1 |
| 2005/0166526 | A1 | | 8/2005 | Stanchfield | |

FOREIGN PATENT DOCUMENTS

| | | | |
|---|---|---|---|
| CH | 471 954 | | 4/1969 |
| DE | 10 2005 002255 | | 7/2006 |
| EP | 1930526 | | 6/2008 |
| FR | 2739122 | | 3/1997 |
| GB | 2152768 | A * | 8/1985 |

* cited by examiner

*Primary Examiner* — Robert Canfield
*Assistant Examiner* — Babajide Demuren
(74) *Attorney, Agent, or Firm* — Robert L. Epstein; Epstein Drangel LLP

(57) ABSTRACT

The baseboard has a side with a first contour and an opposite side with a second contour. In order to be able to mount the baseboard in either of two 180°-rotated positions, the baseboard has a longitudinally extending axis of symmetry. The first contour in a first edge region, rotated through 180° about the axis of symmetry, corresponds to the second contour in a second edge region. Moreover, the second contour in the first edge region, rotated through 180° about the axis of symmetry, corresponds to the first contour in the second edge region.

15 Claims, 1 Drawing Sheet

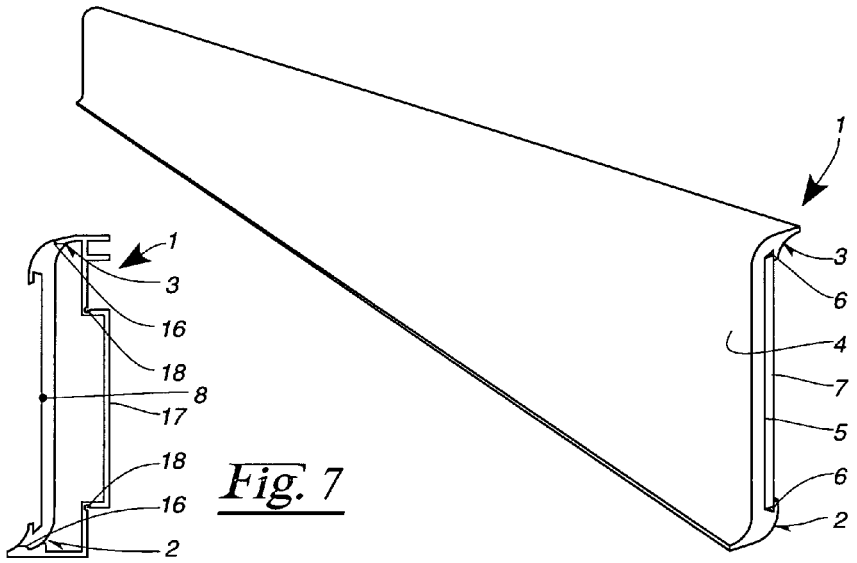
Fig. 1
Fig. 7
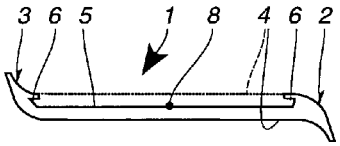
Fig. 2
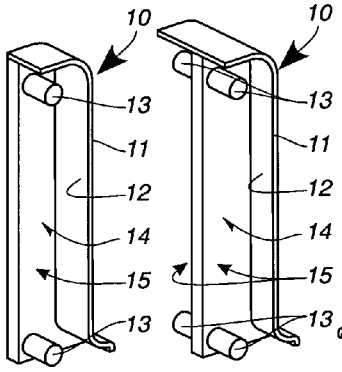
Fig. 3
Fig. 4
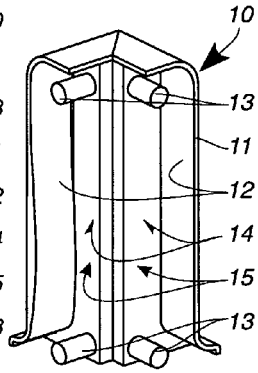
Fig. 5
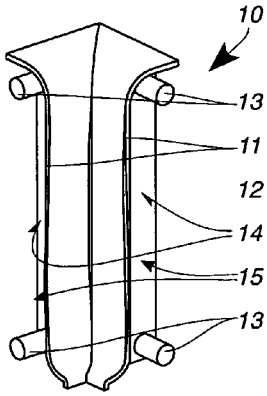
Fig. 6

REVERSIBLE BASEBOARD FOR COVERING A FLOORING BORDER

CROSS-REFERENCE TO RELATED APPLICATIONS

The present application claims priority to German patent application no.: DE 20 2008 014 702.6 filed Nov. 5, 2008, and German patent application no.: DE 20 2008 015 223.2 filed Nov. 17, 2008.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The invention relates to baseboards for covering a flooring border and more particularly to a reversible baseboard for covering a floor boarder and to the connecting pieces therefore.

2. Description of Prior Art Including Information Disclosed Under 37 CFR 1.97 and 1.98

DE 202 00 446 U1 discloses a baseboard having a visible outer contour and a concealed inner contour. The two contours are situated one opposite the other, only the first contour being of relevance. This baseboard serves to cover a flooring border and has proved its worth in practice. It forms the basis for the present invention.

DE 10 2005 011 439 A1 discloses an ornamental profiled element with sealing function, which is configured as a baseboard. This profiled element is configured such that it is not symmetrical in its top and bottom edge regions, so that holding means acting in the edge regions cannot in different rotation positions grip and hold the profiled element. Thus only one contour can be used as a cover shield.

From DE 202 06 984 U1, a core baseboard having a solid material core and a plastics casing is known. The solid core does not therefore extend as far as the edge region, so that a holding of this core baseboard via holding means acting solely in the edge region is not at all possible. Moreover, this core baseboard deforms in the edge regions—by dint of the elastic configuration—to the extent that no axis-symmetrical structure is obtained.

DE 1 878 576 U discloses a skirting board, which is likewise configured non-symmetrically in the edge regions. The fixing of these skirting boards is effected by means of slotted webs, which are formed in the middle region of the skirting board. A 180°-rotated mounting is therefore not possible.

DE 69 01 915 U discloses a connecting piece for skirting boards, which has supporting ribs. The supporting ribs grip the baseboard to be fitted at three locations distributed over the height thereof, in order thereby to ensure a snug seating of the baseboard. The contour of the baseboard is thus predefined, however, within narrow limits, so that the baseboard cannot be mounted in a 180°-rotated position.

The object of the invention is to provide a baseboard of the type stated in the introduction, which is universally usable.

This object is achieved according to the invention with a baseboard having the following features.

BRIEF SUMMARY OF THE INVENTION

The baseboard according to the invention serves to cover a flooring border. In addition, the baseboard can optionally also meet further objects, such as, for example, the realization of a cable duct or the like.

The baseboard has a first contour on one side and a second contour on the opposite side. The baseboard can be mounted with either one of the two sides being visible such that one of the contours is the outer contour and the other is the inner contour. For a more universal applicability of the baseboard, the baseboard has a longitudinally extending axis of symmetry around which the baseboard can be rotated through 180°. In this way, the baseboard is reversible, as either the first contour or the second contour can form the outer side of the baseboard, according to the mounting position.

The two contours can be shaped differently, so that two different designs can be realized with a single baseboard. This reduces the tool and stock keeping costs. In order to be able to mount this baseboard in both positions to corresponding connecting pieces, both contours must be configured partially symmetrically. A middle region of the contours here forms a visual surface of the baseboard and is preferably shaped differently on the two contours. In the middle region, the baseboard preferably has no holding means at all, since these, in the rotated position, would disturb the visual impression.

The baseboard possesses, however, edge regions, which are configured such that they have a limited mutual rotational symmetry. The edge regions preferably extend from the respective edges of each contour over at least 10% of the total contour length. The first contour in the first edge region, rotated through 180° about the axis of symmetry, here corresponds in shape to the second contour in the second edge region. Moreover, the second contour in the first edge region, rotated through 180° about the axis of symmetry, corresponds in shape to the first contour in the second edge region. If the entire baseboard is rotated about the axis of symmetry, in the rotated and non-rotated position, it will be congruent in the edge regions. The result of this specific symmetry is that the baseboard, despite different shaping in the middle region between the edge regions, can be mounted in either rotational position. That is, the baseboard is reversible.

Preferably, assembly means grip the baseboard only at the edge regions of the baseboard. A secure gripping of the baseboard is thereby obtained in either mounting position. Through different shaping of the two contours in the middle region, different visual impressions are obtainable with a single baseboard.

In order that the baseboard can correctly bridge the flooring border, it must extend a short distance in the direction of the flooring. In order to nevertheless be able to obtain an approximately vertical visual surface in the middle region of the baseboard, it is advantageous if the first and second contour in the first edge region are curved or angled off to the same side. The baseboard thereby ensures a flush termination against the flooring, on the one hand, and against the adjoining wall, on the other hand.

In addition to a metal appearance of the baseboard, an ornamental strip is often used, which preferably consists of the same material as the flooring. In order to be able to introduce an ornamental strip of this type into the baseboard and hold it therein, at least one of the contours of the baseboard has at least one slot. The edge of the ornamental strip can be easily pressed into this slot and held on the baseboard.

For mounting the baseboard to the wall, a connecting piece has proved of value. This connecting piece can be, for example, an end piece which is attached to the end of the baseboard and terminates the baseboard. Such end pieces are required, for example, in respect of doors.

The connecting piece has on at least one side a connecting region, where the end of the baseboard can be connected to the connecting piece. This connecting region has a projection overlapping the baseboard, so that the end of the baseboard is thereby covered by the connecting piece. This is important, since the baseboard must normally be adapted in length to the spatial conditions by sawing off. The cut surface is in this case uneven and partly frayed. Such irregularities are covered by the overlapping projection, so that the baseboard with the connecting piece leaves a perfect visual impression.

For engaging the baseboard on the connecting piece, holding pins are situated opposite the projection, the baseboard being able to be held in clamping engagement between the projection and the holding pins. baseboard, For example, the first contour of the baseboard engages the projection and the second contour engages the holding pins, or vice versa. Preferably, the holding pins are provided solely in the edge regions of the connecting regions, so that only the symmetrical edge regions of the baseboard are engaged. A 180°-rotated insertion of the baseboard into the connecting piece is thus easily possible.

In order to be able to rotate the baseboard, it is advantageous, if the holding pins are disposed one above the other. In this way, a fully symmetrical structure of the holding pins is obtained, which simplifies the design.

In order to obtain a snug fit of the end of the baseboard in the connecting piece, it is advantageous if at least one stop is provided between the projection and the holding pins.

In order to improve the visual impression of the baseboard together with the connecting piece, it is advantageous if the projection can fully overlap the baseboard. A uneven end of the baseboard is hereby fully hidden.

It is advantageous if the connecting piece has two connecting regions, which are oriented in mutual alignment or at right angles to each other. If the two connecting regions are oriented in line, an extension piece is obtained, by which a plurality of baseboards, on the front side, can be lined up such that they butt one against the other. This is important, in particular, for installation in large rooms, when the length of a single standard baseboard is not adequate to cover the flooring border.

Alternatively, the connecting regions can be oriented at right angles to each other, allowing both outer corner joints and inner corner joints to be realized. In this way, the baseboards can be adapted to all the conditions in the room, without uneven ends being visible. In this way, in particular, no miter cut of any kind, which is very difficult to accomplish, has to be made.

Alternatively or additionally, the connecting piece for the baseboard can be configured in the form of a clip rail. This clip rail can be fixed to a wall, the baseboard having recesses on its edge regions which are configured to fit the connecting regions of the clip rail. The baseboard can thus be snapped directly into the mounted clip rail. Moreover, the recesses, rotated through 180° about a axis of symmetry, mutually correspond, so that the baseboard can be attached to the clip rail in either position.

BRIEF DESCRIPTION OF THE SEVERAL VIEWS OF DRAWINGS

To these and to such other objects that may hereinafter appears, the present invention relates to a reversible baseboard for covering a floor border . . . as described in detail in the following specification and recited in the annexed claims, taken together with the accompanying drawings, in which like numerals refer to like parts and in which:

FIG. 1 is a perspective view of the baseboard of the present invention,

FIG. 2 is an end view of the baseboard according to FIG. 1 rotated 90° about the axis of symmetry from the position shown in FIG. 1, FIG. 3 is a perspective view of a connecting piece for the one-sided connection of a baseboard, FIG. 4 is a perspective view of a connecting piece as an extension element, FIG. 5 is a perspective view of an outer corner piece, FIG. 6 is a perspective view of an inner corner piece, and FIG. 7 is an end view of the baseboard mounted on a clip rail.

It should be understood, however, that the drawings only serve to illustrate the invention, and should not be taken to restrict the scope of protection of the invention.

DETAILED DESCRIPTION OF THE INVENTION

FIG. 1 shows the baseboard 1 of the present invention. Baseboard 1 has a first edge region 2 (shown at the bottom in this view) and a second edge region 3 (shown at the top in this view). Baseboard 1 has one side with a first contour 4 and a an opposite side with a second contour 5. The second contour 5 here has two oppositely facing slots 6, which serve to receive the edges of an ornamental strip 7. Ornamental strip 7 can be configured basically in any chosen manner. Preferably, a piece is taken of the flooring which is intended to be covered at the border with the baseboard. The appearance of the baseboard 1 is thereby coordinated with that of the flooring.

Referring now to FIG. 2, the baseboard has a longitudinally extending axis of symmetry 8, around which the baseboard can be rotated through 180° relative to the wall to reverse its position. For this purpose, the first contour 4 of the baseboard in the first edge region 2 corresponds in shape to the second contour 5 in the second edge region 3 in the 180°-rotated position. Moreover, the second contour 5 in the first edge region 2 corresponds in shape to the first contour 4 in the second edge region 3 when rotated 180°-. The axis of symmetry 8 here always serves as the pivot axis.

The effect of this structure is that, irrespective of the above-described rotation, the baseboard 1 is congruent in its two edge regions 2, 3, as is indicated by dashed lines. In these edge regions 2, 3, the baseboard 1 can consequently be held without difficulty in either of the rotational positions. Accordingly, the baseboard is reversible such that a single baseboard 1 can be mounted with either the first contour 4 being visible or the second contour 5 being visible, eliminating the need for separate baseboards with sides having different appearances.

FIG. 3 shows a connecting piece 10 for the baseboard according to FIG. 1. This connecting piece 10 has a projection 11, the inner contour 12 of which corresponds to the first contour 4 of the baseboard 1. The projection 11 fully overlaps the baseboard 1, so that the end thereof, which is generally irregular, is no longer visible.

In order to hold the baseboard 1 in the connecting part 10, the connecting part 10 has two holding pins 13. The baseboard 1 is here held clamped between the holding pins 13 and the projection 11. The distance of between the holding pins 13 and the projection 11 is dimensioned such that the baseboard 1 is gripped securely between these parts 11, 13.

The two holding pins 13 are here located one above the other and at such locations so that they engage only the first and second edge region 2, 3 respectively of the baseboard 1. The different contours of the sides of baseboard 1 in a middle region between the two edge regions 2, 3 are hence immaterial to the holding function of the baseboard 1 on the connecting piece 10. The connecting piece 10 is thus able to engage the baseboard 1 in either rotational position.

The connecting piece additionally has a stop face 14, against which the end of baseboard 1 can rest snugly. The stop face 14 limits the extent to which end of the baseboard can be received in the connecting piece 10.

Projection 11 forms together with the holding pins 13 and the stop face 14 a connecting region 15 for the connection to the baseboard 1.

FIG. 4 shows an alternative embodiment of the connecting piece 10, wherein the same reference symbols denote the same parts. Below, the only differences between this embodiment and that of FIG. 3 are discussed.

The connecting piece 10 of FIG. 4 has two substantially identically constructed and mutually aligned connecting regions 15. Thus, baseboards can be received into this connecting piece 10 on both sides, which baseboards are then oriented in mutual alignment. This connecting piece 10 therefore permits multiple the baseboards 1 to be mounted end to end.

FIG. 5 shows an alternative embodiment of the connecting piece 10 according to FIG. 4, wherein the same reference symbols denote the same parts. Below, the only differences between this embodiment and the embodiment of FIG. 4 are discussed.

In the embodiment according to FIG. 5, the two connecting regions 15 are mutually rotated through 90°, so that an outer corner joint is thereby formed. The baseboards 1 connectable to these connecting regions 15—viewed from the room outward—then form an angle of 270°.

FIG. 6 shows a further alternative embodiment of the connecting piece 10 according to FIG. 5, wherein the same reference symbols again denote the same parts.

In this embodiment too, the connecting regions 15 are arranged at 90° to one another, which arrangement is the reverse of the embodiment according to FIG. 5. This connecting piece 10 thus forms an inner corner joint, so that the baseboards 1 connectable to the connecting piece 10, viewed from the room outward, form an angle of 90°.

Finally, FIG. 7 shows a baseboard 1, which, in addition to the embodiment according to FIG. 1, has on both edge regions 2, 3 additional recesses 16. These recesses 16 correspond with parts on a clip rail 17. Clip rail 17 is designed to be fastened to a wall (not shown). Preferably, the clip rail 17 can be glued and/or screwed to the wall. The clip rail 17 has spring axis 18, such that the clip rail 17 is somewhat flexible. This facilitates the mounting of the baseboard 1 by simply snapping it in place on the clip rail. The recesses 16 of the baseboard 1 are shaped such that they are rotationally symmetrical through 180° about the axis of symmetry to allow the baseboard 1 to be mounted in either rotational position.

Since only a limited number of exemplary embodiments of the present invention have been disclosed for purposes of illustration, it should be understood that a large number of changes and modifications to the embodiments described are possible without departing from the essential idea and the scope of protection of the invention defined by the claims.

REFERENCE SYMBOL LIST

1 baseboard
2 first edge region
3 second edge region
4 first contour
5 second contour
6 slot
7 ornamental strip
8 axis of symmetry
10 connecting piece
11 projection
12 inner contour
13 holding pin
14 stop face
15 connecting region
16 recess
17 clip rail
18 spring axis

I claim:

1. A system comprising:

a baseboard for covering a flooring border, said baseboard having a longitudinally extending axis of symmetry, a first side with a first contour and a second oppositely situated side with a second contour, said first contour having a first edge region and a second edge region, said second contour having a first edge region and a second edge region; and a connecting piece;

wherein said first edge region of said first contour corresponds in shape to said second edge region of said second contour, and said first edge region of said second contour corresponds in shape to said second edge region of said first contour, such that said baseboard can be rotated 180° about said axis of symmetry so as to reverse position, and said connecting piece for said baseboard having at least one side on which it, for connection to said baseboard, comprises a connecting region, said connecting region having a projection adapted to overlap a portion of said baseboard when said baseboard is received in said connecting region, said connecting piece further comprising holding pins situated opposite said projection, said baseboard being able to be held, solely in its edge regions, in clamping engagement between said projection and said holding pins.

2. The system as claimed in claim 1, wherein said first edge region of said first contour curves to the same side as said first edge region of said second contour.

3. The system as claimed in claim 1, wherein said first edge region of said first contour angles off to the same side as said first edge region of said second contour.

4. The system as claimed in claim 1, wherein at least one of said first and second contours has at least one slot for receiving an ornamental strip.

5. The system as claimed in claim 1, wherein said holding pins are disposed one above the other.

6. The system as claimed in claim 1, wherein at least one stop face is provided between said projection and said holding pins.

7. The system as claimed in claim 1, wherein said projection can fully overlap said baseboard.

8. The system as claimed in claim 1, wherein said connecting piece has two stop regions, which are oriented in mutual alignment.

9. The system as claimed in claim 1, wherein said connecting piece has two stop regions, which are oriented at right angles to each other.

10. A system comprising:

a baseboard for covering a flooring border, said baseboard having a longitudinally extending axis of symmetry, a first side with a first contour and a second oppositely situated side with a second contour, said first contour having a first edge region and a second edge region, said second contour having a first edge region and a second edge region, wherein said first edge region of said first contour corresponds in shape to said second edge region of said second contour, and said first edge region of said second contour corresponds in shape to said second edge region of said first contour, such that said baseboard can be rotated 180° about said axis of symmetry so as to reverse position; and a connecting piece for said baseboard, said baseboard being of the type having edge regions which respectively have recesses, said connecting piece having an axis of symmetry and at least one side on which it, for connection to said baseboard, comprises an upper and lower connecting region, wherein said connecting piece is configured in the form of a clip rail which can be fixed to a wall, the recesses of said baseboard being configured to fit said upper and lower connecting regions of the connecting piece, and when baseboard is rotated through 180° about said longitudinally extending axis of symmetry, said recesses correspond to said other of said upper and lower connecting regions.

11. The system as claimed in claim 1, wherein said second edge region of said second contour is oriented with respect to one of a fixed flooring border and a fixed connecting piece after said baseboard is rotated 180° about said axis of symmetry in the same manner as said first edge region of said first contour is oriented with respect to the one of the fixed flooring border and the fixed connecting piece prior to being rotated.

12. The system as claimed in claim 1, wherein said second edge region of said first contour is oriented with respect to one of a fixed flooring border and a fixed connecting piece after said baseboard is rotated 180° about said axis of symmetry in the same manner as said first edge region of said second contour is oriented with respect to the one of the fixed flooring border and the fixed connecting piece prior to being rotated.

13. The system as claimed in claim 10, wherein said second edge region of said second contour is oriented with respect to one of a fixed flooring border and a fixed connecting piece after said baseboard is rotated 180° about said axis of symmetry in the same manner as said first edge region of said first contour is oriented with respect to the one of the fixed flooring border and the fixed connecting piece prior to being rotated.

14. The system as claimed in claim 10, wherein said second edge region of said first contour is oriented with respect to one of a fixed flooring border and a fixed connecting piece after said baseboard is rotated 180° about said axis of symmetry in the same manner as said first edge region of said second contour is oriented with respect to the one of the fixed flooring border and the fixed connecting piece prior to being rotated.

15. The system as claimed in claim 10, wherein said system is adapted to allow said baseboard to be selectively connected to the connecting piece so that said first contour is visible in first position, and said second contour is visible in a second position, said baseboard being rotated through said longitudinally extending axis of symmetry in moving from the first position to the second position.

* * * * *